US007437853B1

(12) United States Patent
Jensen

(10) Patent No.: US 7,437,853 B1
(45) Date of Patent: Oct. 21, 2008

(54) OPENABLE SCREEN ELEMENT SUCH AS A DOOR

(75) Inventor: Timothy Jacob Jensen, Hojslev (DK)

(73) Assignee: Multi-Tek A/S, Randers (DK)

( * ) Notice: Subject to any disclaimer, the term of this patent is extended or adjusted under 35 U.S.C. 154(b) by 0 days.

(21) Appl. No.: 10/031,287

(22) PCT Filed: Jun. 26, 2000

(86) PCT No.: PCT/DK00/00344

§ 371 (c)(1),
(2), (4) Date: May 17, 2002

(87) PCT Pub. No.: WO01/06080

PCT Pub. Date: Jan. 25, 2001

(30) Foreign Application Priority Data

Jul. 14, 1999 (DK) ..... 1999 01022

(51) Int. Cl.
*E06B 3/00* (2006.01)

(52) U.S. Cl. ..... 49/501

(58) Field of Classification Search ..... 49/501, 49/339, 340, 25, 163, 70, 171; 52/784.1, 52/784.11, 782.1, 455, 56, 57, 58; 312/405, 312/326, 327, 329

See application file for complete search history.

(56) References Cited

U.S. PATENT DOCUMENTS 2,018,872 A * 10/1935 Harry ..... 49/48
3,061,056 A * 10/1962 Kodaras ..... 312/405
3,516,197 A 6/1970 Lyons
3,896,741 A * 7/1975 Chapman ..... 410/6
4,103,458 A * 8/1978 Booker ..... 49/56
4,440,459 A * 4/1984 Hallgren ..... 312/238
4,664,437 A * 5/1987 Queveau ..... 296/146.8
4,720,876 A * 1/1988 Tomei et al. ..... 4/614
5,016,395 A * 5/1991 Walker et al. ..... 49/501
5,147,122 A * 9/1992 Short ..... 312/321.5
5,212,907 A * 5/1993 Van Sandt ..... 49/70

(Continued)

FOREIGN PATENT DOCUMENTS

EP 0 287 362 10/1988

(Continued)

*Primary Examiner*—Jerry Redman
(74) *Attorney, Agent, or Firm*—Merchant & Gould P.C.

(57) ABSTRACT

The present invention relates to an openable screen element such as an insert unit to be inserted into an opening of a wall, particularly a door or a window, comprising at least one screen element side-hinged to the frame structure, said screen element being pivotally mounted over a hinge axis in the frame structure for opening and closing in a direction away from the opening, where the screen element comprises two mutually angled planar sectional elements preferably rectangular in shape, positioned in different planes with an intersection line essentially parallel with the hinge axis. Apart from being communication surfaces containing information of the activities in a room with one or more doors according to the invention mounted into the walls, the screen element, such as a door surface of a screen element according to the invention, will also be able to function as a direction pointer or provide visual indication of the direction for opening of the screen element (door or window) due to its bent shape. With the two planar sectional elements of the door being mutually angled, it is also possible to obtain a light/shadow effect that will be able to break the visual experience of the wall portion wherein the screen element has been integrated.

3 Claims, 4 Drawing Sheets

U.S. PATENT DOCUMENTS 5,319,882 A * 6/1994 Biebuyck ..... 49/371
5,558,418 A * 9/1996 Lambright et al. ..... 312/321.5
5,878,530 A * 3/1999 Eccleston et al. ..... 49/139
5,927,011 A * 7/1999 Sickenius ..... 49/56
6,164,013 A * 12/2000 Ramsey ..... 49/70
6,213,577 B1 * 4/2001 Rooyakkers et al. ..... 312/265.3
6,357,509 B1 * 3/2002 Lamazares ..... 160/210

FOREIGN PATENT DOCUMENTS

SE 406 484 2/1979

* cited by examiner

OPENABLE SCREEN ELEMENT SUCH AS A DOOR

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

FIELD OF THE INVENTION

The present invention relates to a screen element such as an insert unit to be inserted into an opening of a wall, especially a door or a window, comprising at least one screen element side-hinged to a frame-structure, said screen element being pivotally mounted over a hinge axis in a frame structure for opening and closing in a direction away from the opening.

BACKGROUND OF THE INVENTION

Buildings and building interior in general feature a wide variety of doors and windows in order to separate two rooms in a building structure. These doors may be of different shapes depending on their function, and include e.g. a fire door, gates, or main entrances to wall fronts providing access to a building. For interior use, they are used as room separators or fire doors in long corridors or walking areas of e.g. office buildings. Interior doors may come in many shapes and sizes. Common to these door types is the fact that they consist of an essentially plate-shaped screen element in a hard material, typically wood, glass, steel or aluminium or combinations thereof. The door plate is hinged to a frame-structure in the shape of a door case and is provided with a handle for opening and closing of the door. By larger openings, such as corridors, where division is required due to fire protection, double doors may be used.

The doors may be provided with various ornaments on the surface but they all have in common that they show a plane screening of the door opening.

Other types of doors include flexible doors, such as folding doors, that do not open away from the opening, where a screen element of this kind may be folded when the door is opened since the door opening is provided with guiding rails at the top and bottom. A folding door requires quite a lot of space when it is opened and is thus only advantageous if the wall opening is relatively wide and when one or two side-hung doors are not practical.

Often, it will be practical to provide the wall immediately next to the door with a sign or the like, possibly extending out into the room, so that by-passers may determine where they are. Also, the doors may be provided with special colours by which communication with the persons in the room (s) behind the doors may be established.

However, by the present invention it is realized that by departing from the traditional design of doors, this communication effect may be integrated in the door.

BRIEF SUMMARY OF THE INVENTION

Thus, the present invention relates to a screen element of the initially mentioned kind comprising two mutually angled, planar sectional elements preferably rectangular in shape with differing planes and an intersection line which is essentially parallel with the hinge axis.

The first planar sectional element is preferably significantly wider than the second planar sectional element.

Apart from acting as communication surfaces bearing information about the persons in the room with one or more doors according to the invention integrated the walls, the screen element, such as the door plate of a screen element according to the invention, may also act as a direction pointer or provide visual indication of the direction in which the screen element may be opened (the door or the window) due to its bent shape. The two plane surfaces, which are mutually angled, also provide a light/shadow effect that may break the visual experience of the wall portion wherein the screen element is integrated.

In another embodiment of the invention, an openable screen element as the one disclosed above has been provided with lighting means and optional sensor means for activating the lighting means in the screen element or/and the frame structure. In this manner, it will also be possible to obtain a communicative effect for indication of the opening direction of the door and/or stating to which activity or person the room behind the door relates or belongs. In addition, it is possible to establish integrated lighting in e.g. the frame above the door which will automatically be activated when activity outside the door is registered.

In the preferred embodiment of a screen element according to the invention, the two planar sectional elements are positioned in two planes with a mutual angle of 10° to 20°, preferably around 15°. In this manner, a geometry is created whereby the screen element extends sufficiently out from the wall portion to ensure the communicative effect without the screen appearing as a hindrance to the functionality of the room and the door geometry appearing as a hindrance to the opening of the door.

In a preferred embodiment of a screen element according to the invention, the screen element is provided with a rebate along at least the side and top ends, said rebate having a complimentary cross section shape in relation to the cross section of the frame structure. In this manner, the frame will be covered and removed from the visual impression of the side of the room in which the door is opened.

In a first embodiment, the two planar sectional elements have two planes that both differ from the plane of the wall opening. This provides the opportunity to use both elements as communication surfaces.

In a second embodiment, the first, planar sectional element has a plane parallel or coincident with the wall plane and the second planar sectional element has a differing plane. In this manner, the angled planar sectional element and the part of the frame structure connected herewith may be provided with communicative signalling means.

In yet another embodiment of an element according to the invention, the element contains two screen elements which are side-hinged at each side of the frame structure. In this manner, a double screen element, especially a double door, is provided and features a visual opening indication.

In a first embodiment of a double element according to the invention, the two screen elements have the same opening direction whereby the double door is suited for screening wide wall openings.

In a second embodiment, the two screen elements have opposite opening directions. In this manner, a double door according to the invention is obtained which is particularly suited for e.g. a swing door solution, e.g. at the end of a corridor or the like, where many persons pass back and forth. With a screen according to this embodiment of the invention, the visual opening indication will be able to create a separation of traffic through the door opening and thereby minimize the risk of personal damage to people being in proximity to the door and especially in the opening direction of that door. This is made possible by the visual opening indicator with which the bent screen elements have been provided.

In a preferred area of use of an element according to the invention, the screen is a fire door.

In another aspect of the invention, the screen element of the door has at least one internal space between two outer surfaces wherein internal automatic door closing means connected with the side hinge means have been arranged. Hereby, it is possible to shield not only the frame of a fire door but also the automatic door closing means so that it does not appear disruptive for the visual impression of the door.

BRIEF DESCRIPTION OF THE SEVERAL VIEWS OF THE DRAWINGS

In the following, the invention has been described in detail with reference to the drawings in which.

DETAILED DESCRIPTION OF THE INVENTION

Figure 1:
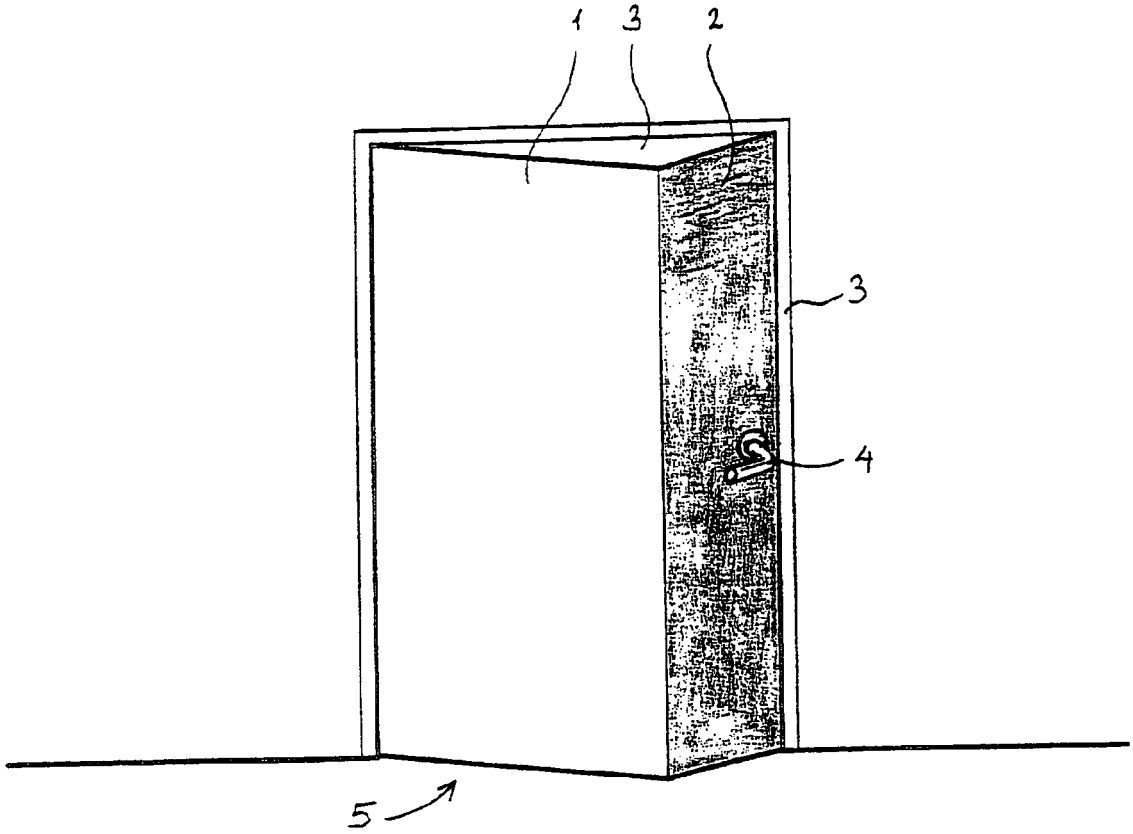
FIG. 1 shows a door in a preferred embodiment of a screen element according to the invention.

FIG. 1 shows a screen element according to the invention in the shape of a door mounted in a wall opening 5. The door may either be an outer door or a door integrated in an interior wall construction. The special thing about this door is that it is designed with a "bend" since the main surface of the door has two planar sectional elements 1,2, mutually angled at an angle of 10° to 20°, and preferably 15°. The door surface is designed in a material that is bent or assembled in such a manner that the first planar sectional element 1 is wider than the second planar sectional element 2. By the first planar sectional element 1, the door plate or the screen element is hinged at one side (see e.g. FIGS. 2 and 7) to a frame structure 3. At the opposite side, the plate is bent or in another way extended into the second planar sectional element 2, wherein a door handle 4 is mounted with locking means, such as a locking pawl. Corresponding locking means are mounted in the frame 3 for fixing and potentially locking the door in a closed position.

Figure 2:
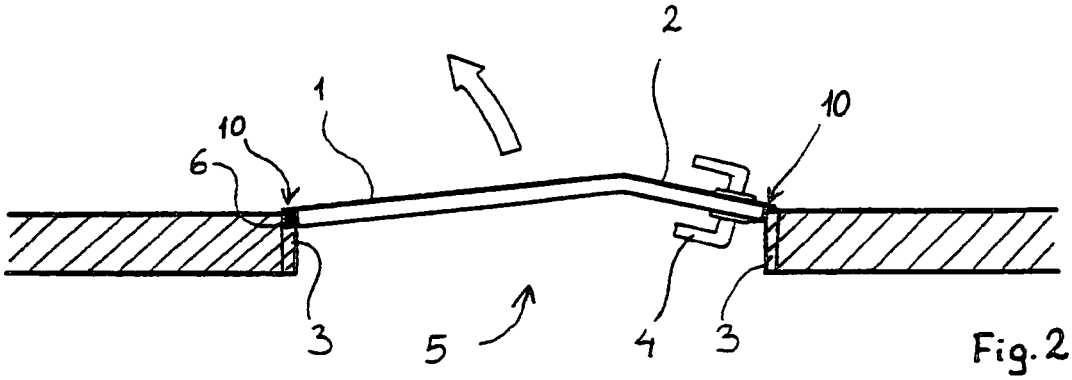
FIGS. 2 & 3 show two alternative embodiments of the invention.
Figure 3:
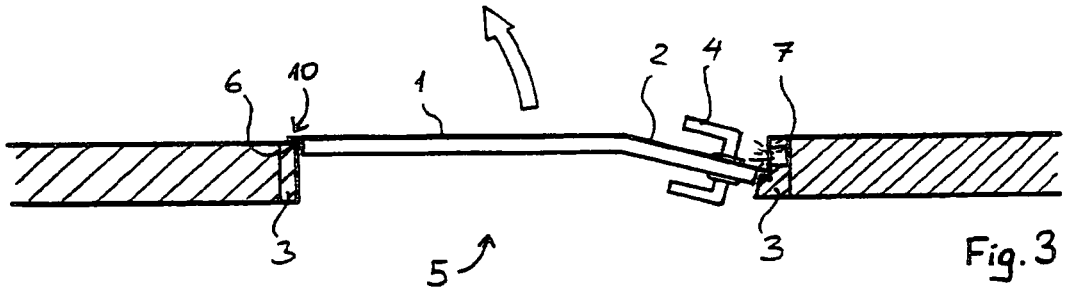

As shown in FIGS. 2 and 3, a screen element according to the invention may essentially be mounted in the wall opening 5 in two different ways. FIG. 2 shows a first possibility where the two surfaces 1,2 extend out into the room in which the door is opened. Thus, when in closed position, the two planar sectional elements are positioned in different planes from the wall plane of the opening 5. The other principal possibility of mounting a screen element according to the invention in a wall opening is to ensure that one of the planar sectional elements 1,2 is parallel with the wall plane. Thus, in FIG. 3 the main plane, which is the first planar sectional element 1, is arranged parallelly with the wall plane.

As is apparent from FIGS. 2 and 3, the door may be provided with a rebate 10 whereby a tightening between the door 1,2 and the frame 3 may be established, just as the rebate 10 may be designed in such dimensions that the flame 3 may be entirely hidden behind the rebate 10.

Figure 4:
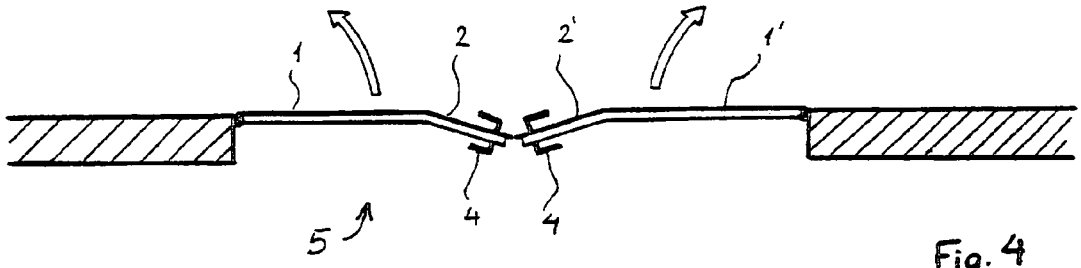
FIGS. 4 to 6 show three double embodiments of a screen element according to the invention.
Figure 5:
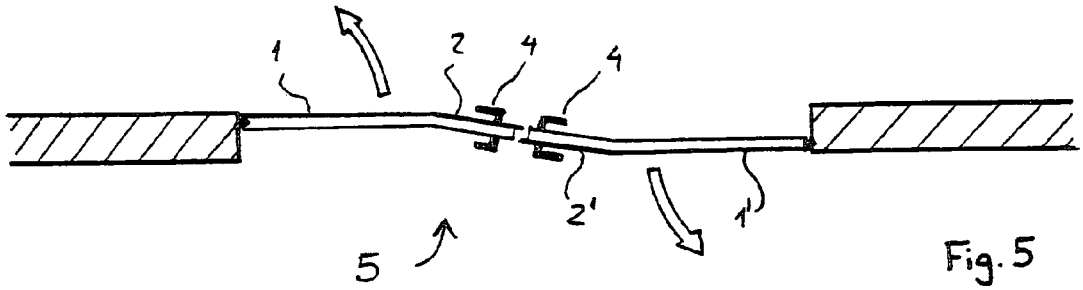
Figure 6:
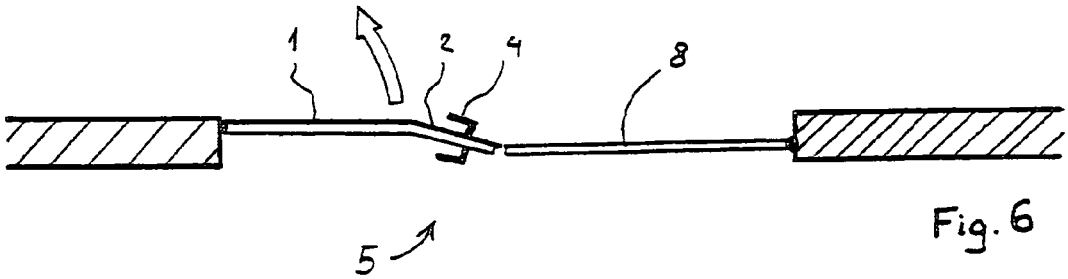

FIGS. 4 to 6 show various embodiments of a double door by using a screen element according to the invention. The embodiment shown in FIG. 4 is a double door element with two doors according to the invention opening in the same direction. The two doors are laterally reversed in design so that the two "bent" sectional elements 2,2' angled in relation to the main planes the opening direction of the door element. The embodiment in FIG. 5 shows a double door element with two doors according to the invention opening in opposite directions which has been created by making the doors similar in shape, the bend between the planar sectional elements 1,2, 1' and 2' respectively, and showing the opening direction of each of the doors constituting the double door. FIG. 6 shows an embodiment where only one door is a screen element according to the invention. In this case, the other part 8 of the door may be blinded but may be opened if required, e.g. during transportation of particularly wide furniture, machines or the like through the door opening.

The doors illustrated in FIGS. 2 to 6 have all been provided with locking means and a door knob 4 at each side of the door. Naturally, by the invention, it is also realized that the doors may alternatively be provided with knobs on just one or none of the sides if required by the conditions.

Figure 7:
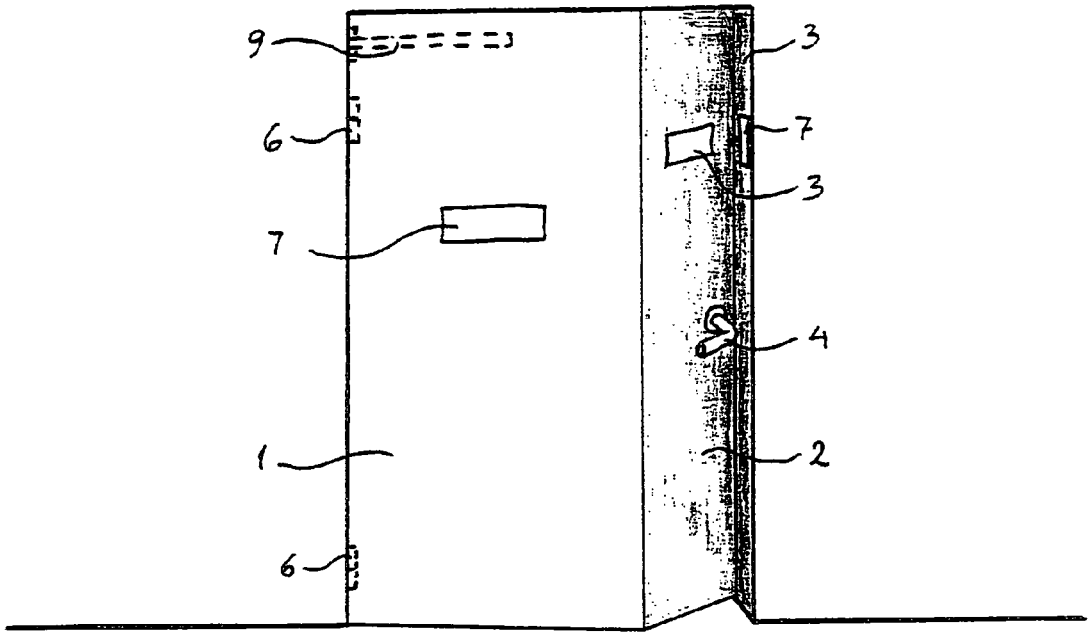
FIG. 7 shows a door according to another embodiment of the invention.

FIG. 7 shows various other aspects of the invention. In order to provide the door with a communicative effect, or improve this effect, the frame 3, the door planes 1,2 or the space immediately above the frame may be provided with lighting means 7 and optional sensor means for activating the lighting means 7 by e.g. activity outside the door. The lighting means may consist of light boxes 7, e.g. in the frame 3, or even directly in the wall opening. The light boxes 7 may be in the shape of signs, e.g. with a logo or bear information of the activity or person to which the room behind the door relates.

Alternatively or as a supplement, either one or both of the planar sectional elements 1,2 may be provided with signs in the shape of an inscription, logo or the like.

FIG. 7 also illustrates the possibility of concealing automatic door closing means 9 in the door, just as it will be possible to use spring hinges 6. However, this presupposes that the door surface is of a certain robustness but will be particularly attractive in relation to a fire door, since the outer surfaces of a door according to the invention are designed in steel in the shape specified by this invention.

By the above-mentioned description of a screen element according to the invention, the invention relates to a door used either for interior room separation in buildings, internal or external fire doors, main doors and entrances etc. However, it is understood that the invention may also be used in relation to the design of windows in order to provide the corresponding built-in communicative effects described above in relation to a door.

The invention claimed is:

1. An openable screen element unit in a building structure for insertion in an opening of a wall in said building structure, said screen element unit comprising at least one screen element side-hinged to a frame structure, said screen element being pivotally mounted over a hinge axis in the frame structure for opening and closing in a direction away from the opening:

wherein the screen element comprises first and second planar sections, said first and second planar sections being mutually angled and arranged in different planes with an intersection line substantially parallel to the hinge axis;

wherein said first planar section has a first visible surface providing a first appearance and said second planar section has a second visible surface providing a second appearance visually distinguishable from the first appearance when said screen element is integrated into the wall;

wherein the first and second planar sections are placed in two planes with a mutual angle of 10° to 20°; and wherein the screen element unit comprises two screen elements side-hinged on either side of the frame structure and wherein the two screen elements have opposite opening directions.

2. An openable screen element unit according to claim 1, wherein said first planar section has a first visible surface reflecting light and creating shadows to produce said first appearance and said second planar section has a second visible surface reflecting light and creating shadows to produce said second appearance visually distinguishable from the first appearance when said screen element is integrated into the wall.

3. An openable screen element unit according to claim 1, wherein said first planar section has a first visible surface reflecting light and creating shadows to produce a first shade and said second planar section has a second visible surface reflecting light and creating shadows to produce a second shade visually distinguishable from the first shade when said screen element is integrated into the wall.

* * * * *